US007238058B1

(12) United States Patent
French

(10) Patent No.: US 7,238,058 B1
(45) Date of Patent: Jul. 3, 2007

(54) GROUNDING PLUG

(76) Inventor: Vernon E. French, 2870 County Rd. 29, Kennard, NE (US) 68034

( * ) Notice: Subject to any disclaimer, the term of this patent is extended or adjusted under 35 U.S.C. 154(b) by 35 days.

(21) Appl. No.: 11/340,097

(22) Filed: Jan. 26, 2006

(51) Int. Cl.
*H01R 24/04* (2006.01)

(52) U.S. Cl. ..... 439/668

(58) Field of Classification Search ..... 439/668, 439/669, 482, 101; 324/508, 555, 556
See application file for complete search history.

(56) References Cited

U.S. PATENT DOCUMENTS

| | | | | | |
|---|---|---|---|---|---|
| 2,641,630 | A * | 6/1953 | Goldberger et al. | ..... | 324/72.5 |
| 2,954,544 | A * | 9/1960 | Focosi | ..... | 439/668 |
| 3,768,005 | A * | 10/1973 | Louks | ..... | 324/555 |
| 4,011,000 | A * | 3/1977 | Wharton | ..... | 439/551 |
| 4,783,619 | A * | 11/1988 | Herman | ..... | 320/127 |
| 4,988,315 | A * | 1/1991 | Wharton | ..... | 439/668 |
| 5,007,863 | A * | 4/1991 | Xuan | ..... | 439/639 |
| 5,116,248 | A * | 5/1992 | Hiers et al. | ..... | 439/669 |
| 5,131,869 | A * | 7/1992 | Wharton | ..... | 439/620.34 |
| 5,131,870 | A * | 7/1992 | El-Haj | ..... | 439/668 |
| 5,201,677 | A * | 4/1993 | Takayama | ..... | 439/668 |
| 5,263,879 | A * | 11/1993 | Sasa et al. | ..... | 439/668 |
| 5,387,136 | A * | 2/1995 | Britton | ..... | 439/668 |
| 5,431,585 | A * | 7/1995 | Fan | ..... | 439/668 |
| 5,434,510 | A * | 7/1995 | Halstead | ..... | 324/555 |
| 5,593,323 | A * | 1/1997 | Dernehl | ..... | 439/668 |
| 5,599,204 | A * | 2/1997 | Glassford | ..... | 439/502 |
| 5,626,496 | A * | 5/1997 | Hahn | ..... | 439/668 |
| 5,775,952 | A * | 7/1998 | Lu | ..... | 439/668 |
| 5,964,616 | A * | 10/1999 | Eisenbraun | ..... | 439/490 |
| 5,964,623 | A * | 10/1999 | Maher et al. | ..... | 439/668 |
| 6,368,157 | B1 * | 4/2002 | Bottazzi, Jr. | ..... | 439/668 |
| 6,394,851 | B1 * | 5/2002 | Paciorek | ..... | 439/668 |
| 6,612,875 | B1 * | 9/2003 | Liao | ..... | 439/675 |
| 6,682,356 | B2 * | 1/2004 | Erez et al. | ..... | 439/108 |
| 6,855,003 | B1 * | 2/2005 | Wyant | ..... | 439/502 |

OTHER PUBLICATIONS

Lisle Corporation Internet web page entitled "Specialty Automotive Tools" regarding the 32150 Power/Ground Outlet, Undated.

* cited by examiner

*Primary Examiner*—Tulsidas C. Patel
*Assistant Examiner*—Vladimir Imas

(57) ABSTRACT

A grounding plug for use with an accessory power outlet in a vehicle to ground an electrical test device such as a fuse tester, test light, multimeter, circuit tester, etc. The grounding plug is provided with a grounding member positioned therein with one end of the grounding member extending outwardly from the grounding plug to provide a grounding terminal and a spring-like contact extending laterally from the grounding plug which engages the grounding portion of the accessory power outlet. The ground lead of the test device is attached to the grounding terminal of the grounding plug to ground the test device.

28 Claims, 5 Drawing Sheets

GROUNDING PLUG

BACKGROUND OF THE INVENTION

1. Field of the Invention

This invention relates to a grounding plug and more particularly to a grounding plug for use with electrical test devices such as fuse testers, test lights, multimeters, etc. Even more particularly, the grounding plug of this invention is designed to be used with an accessory power outlet in a vehicle to provide a ground for the electrical test device.

2. Description of the Related Art

Many electrical test devices such as fuse testers, test lights, multimeters, etc., which are utilized in automotive repair work, require that the test devices be grounded. In the past, the grounding of the test devices did not pose a problem since the older vehicles were constructed of a large number of metal components which made it relatively easy for a technician to ground the electrical test device. However, in recent years, plastic and composite components have been substituted for metal components, thereby making it difficult for a technician to find or reach a metal component suitable for attaching the ground lead of the electrical test device thereto to ground the test device.

SUMMARY OF THE INVENTION

The grounding plug of this invention is designed to be inserted into an accessory power outlet in a vehicle to provide a ground for an electrical test device such as a fuse tester, test light, multimeter, circuit tester, etc. The grounding plug is elongated and generally cylindrical and has first and second ends. An electrically conductive grounding member in the form of a metal strip is positioned in the grounding plug with the grounding member including a first terminal portion which protrudes from the first end of the grounding plug and a contact portion which extends outwardly from the grounding plug between the first and second ends thereof. The first terminal portion of the grounding member is adapted to have the ground lead of an electrical test device affixed thereto. The grounding plug is inserted into the accessory power outlet in a vehicle so that the contact portion of the grounding member contacts the grounding portion of the accessory power outlet, thereby grounding the electrical test device.

It is therefore a principal object of the invention to provide a grounding plug.

A further object of the invention is to provide a grounding plug for use with electrical test devices such as fuse testers, test lights, multimeters, circuit testers, etc.

A further object of the invention is to provide a grounding plug which is adapted to be inserted into an accessory power outlet in a vehicle to ground an electrical test device being utilized by a technician.

Yet another object of the invention is to provide a grounding plug for electrical test devices which is convenient to use.

These and other objects will be apparent to those skilled in the art.

DETAILED DESCRIPTION OF THE INVENTION

Figure 1:
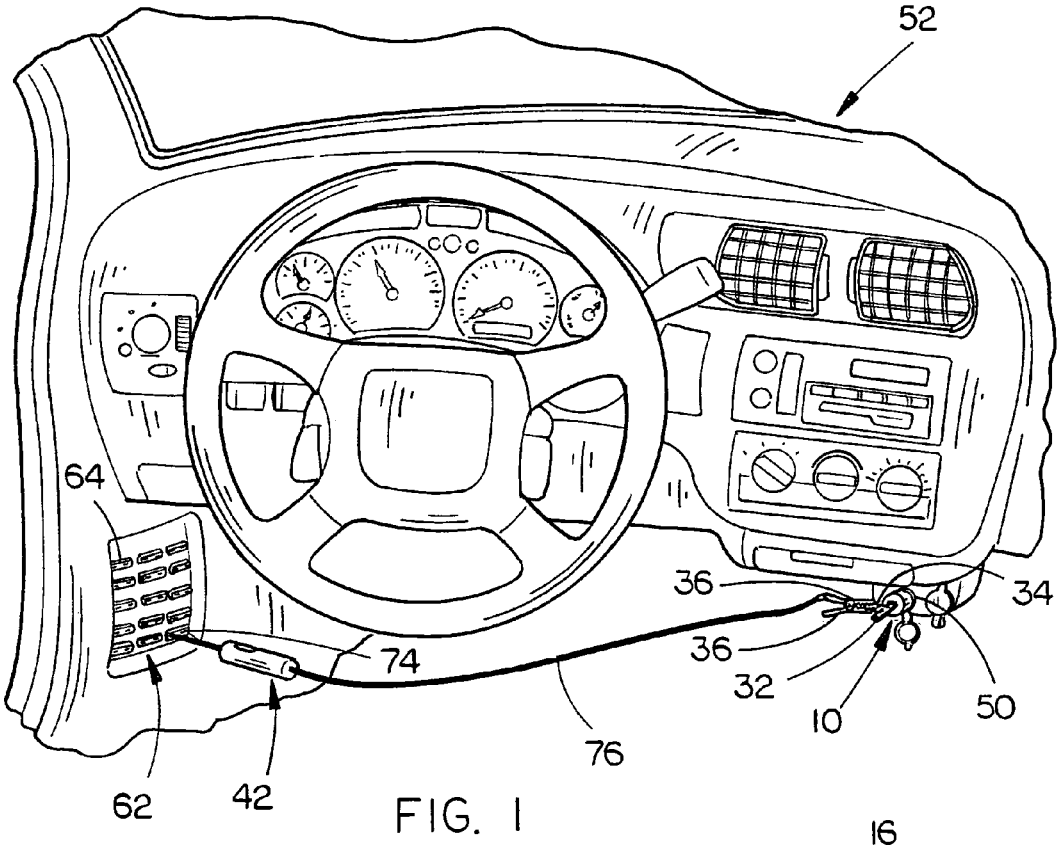
FIG. 1 is a partial perspective view illustrating the grounding plug of this invention being utilized to ground a fuse tester.

The grounding plug of this invention is referred to generally by the reference numeral 10 and which includes plug halves or members 12 and 14 joined together to form the plug. The plug halves or members 12 and 14 are constructed of a non-electrical conductive material such as plastic or the like. For purposes of description, plug 10 will be described as having a first end 16 and a second end 18. Plug member 12 includes a plurality of female receptacles, sleeves or tubes 20 extending inwardly therefrom. Plug member 14 has a plurality of male posts 22 extending inwardly therefrom which are adapted to be received by the female receptacles 20 when the plug members 12 and 14 are joined together.

Figure 2:
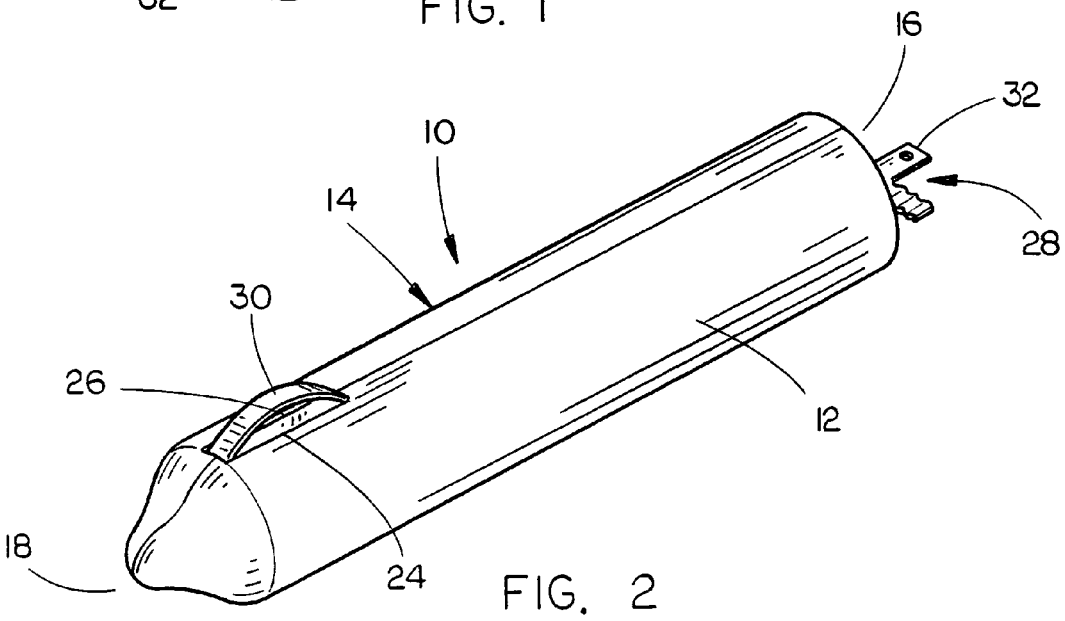
FIG. 2 is a perspective view of the grounding plug of this invention.
Figure 4:
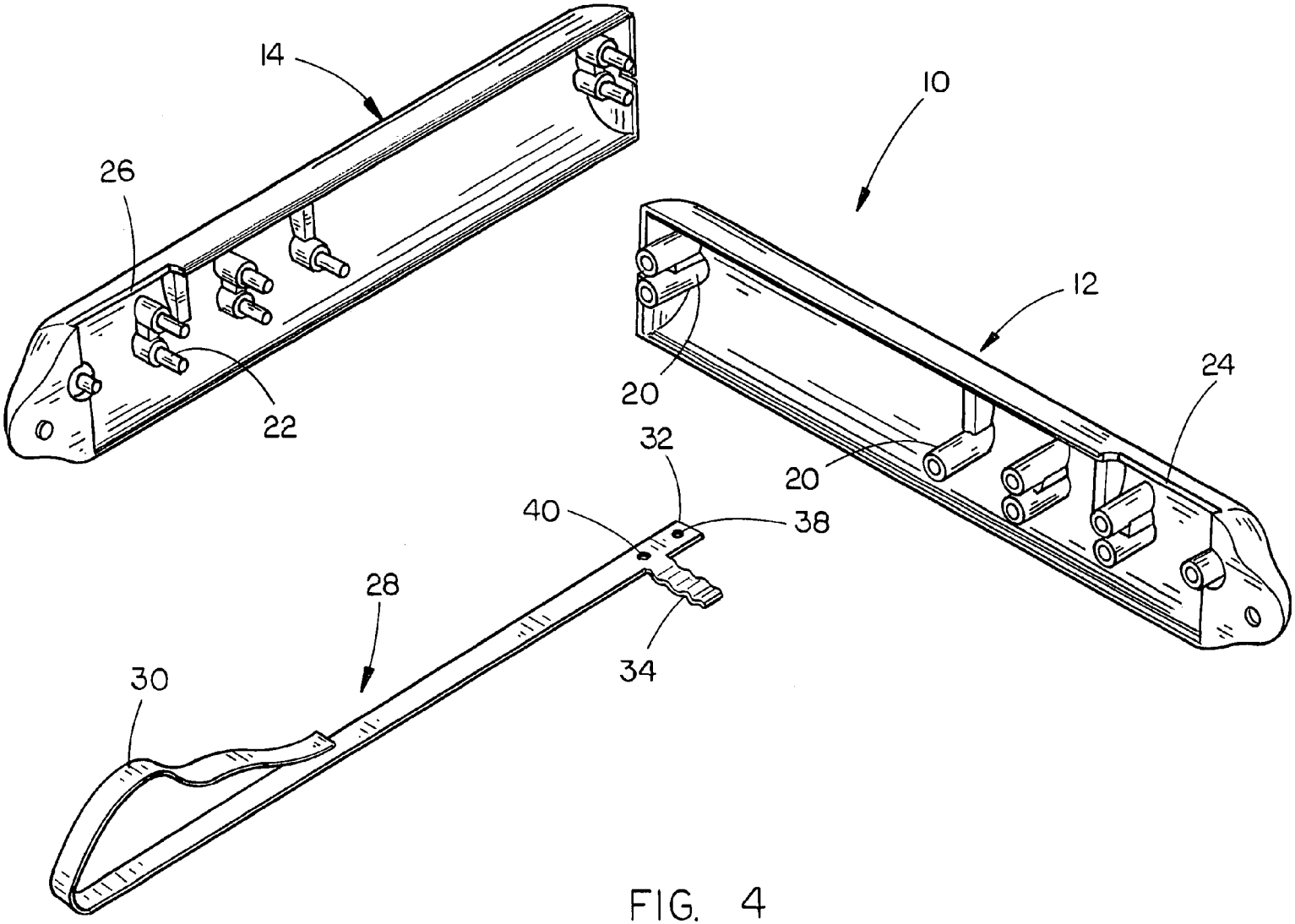
FIG. 4 is an exploded perspective view of the grounding plug of this invention.
Figure 5:
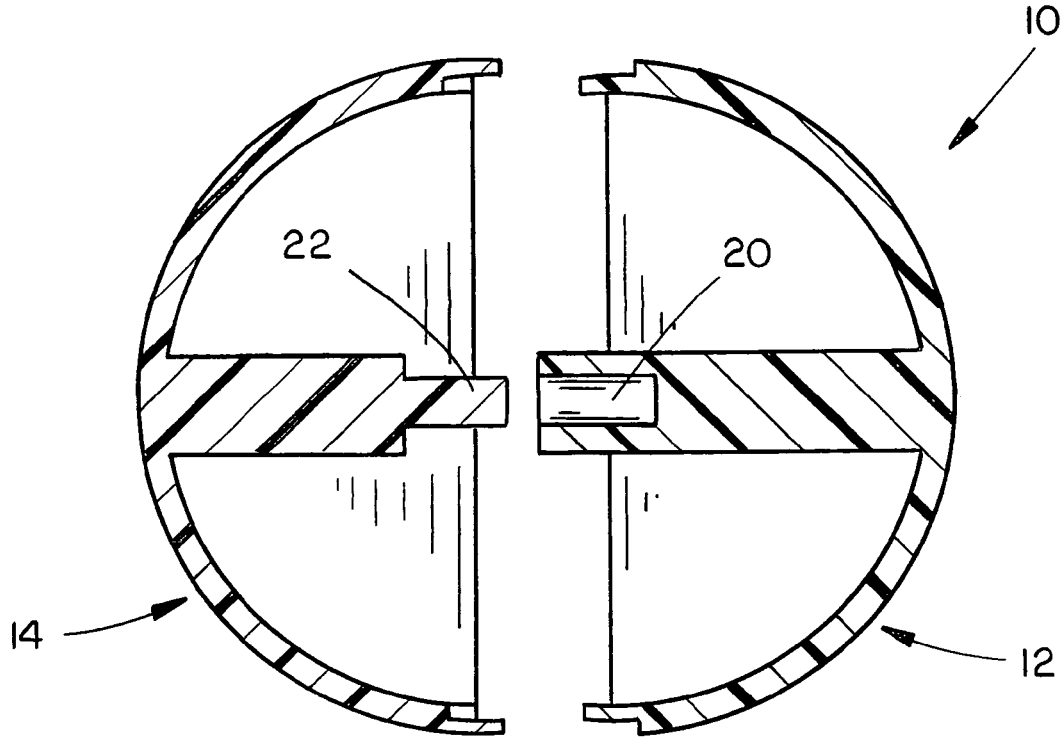
FIG. 5 is a sectional view illustrating the plug halves or members about to be joined.
Figure 6:
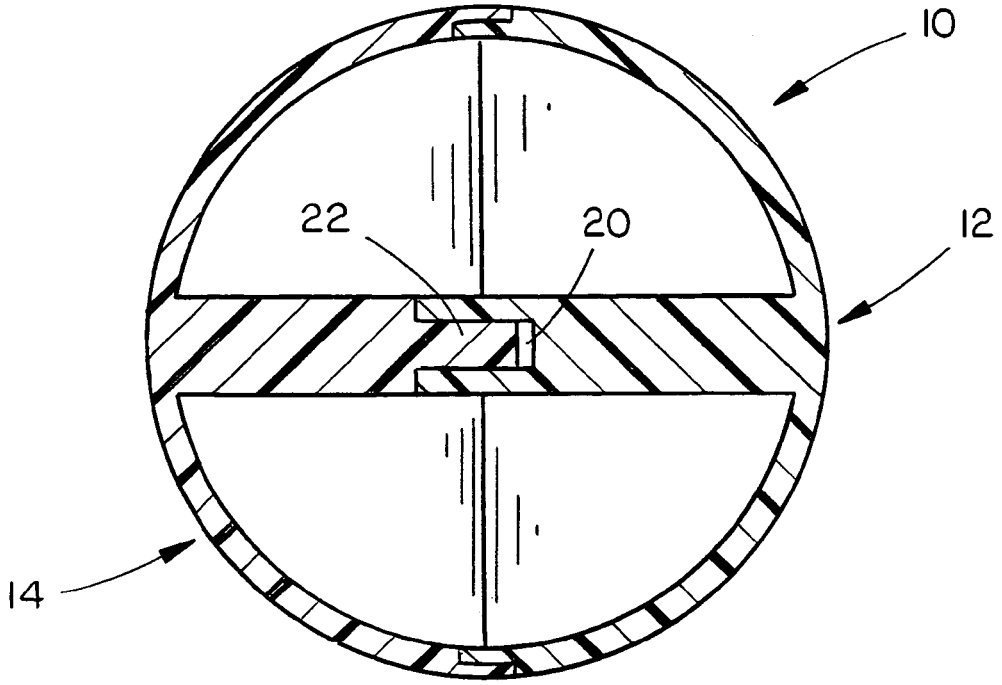
FIG. 6 is a view similar to FIG. 5 except that the plug halves or members are joined together.

Plug member 12 is provided with a notch 24 formed therein while plug member 14 is provided with a notch 26 formed therein with notch 26 adapted to register with notch 24. FIGS. 5 and 6 illustrate the manner in which the plug members 12 and 14 are connected together to form the plug 10. Plug 10 is provided with an electrically conductive grounding member referred to generally by the reference numeral 28 which is preferably comprised of a strip of electrically conductive metal bent upon itself, as illustrated in FIG. 4, to provide a yieldably movable spring-like contact portion 30 with the contact portion 30 extending outwardly through the notches 24 and 26, as illustrated in FIG. 2. Grounding member 28 has a terminal portion 32 which protrudes outwardly from end 16 of plug 10, as illustrated in FIG. 2. Preferably, grounding member 28 is provided with a laterally extending terminal portion 34 which extends from terminal 32. Preferably, the terminal portion 34 is serrated to provide a good gripping surface for an alligator clip 36 or the like. Preferably, the terminal 32 is provided with a pair of openings 38 and 40 formed therein for receiving a ground lead therein or a grounding prong or the like. If desired, the terminal portion 34 may be pivotally secured to the terminal 32 to enable the terminal portion 34 to be moved from a laterally extending position, such as illustrated in FIG. 4, to a position wherein it is parallel to the terminal 32.

Figure 7:
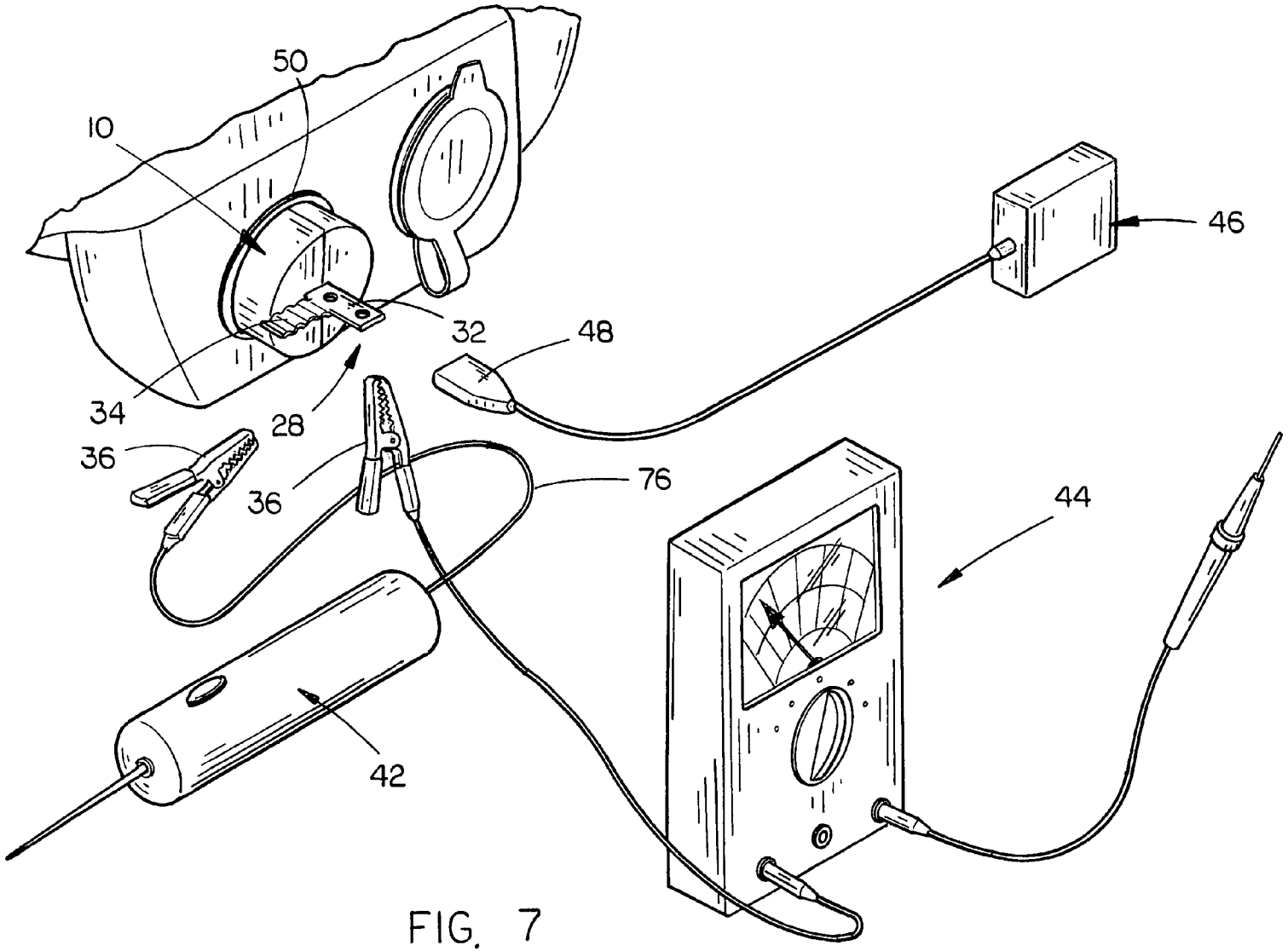
FIG. 7 is a perspective view illustrating the grounding plug of this invention inserted into an accessory power outlet in a vehicle with a circuit tester, fuse tester and multimeter being illustrated which are adapted to be connected to the terminal of the grounding plug.

The grounding plug of this invention is designed to be used with a fuse tester 42, a test light, a multimeter 44, circuit tester 46, or any other electrical test device requiring grounding. As seen in FIG. 7, the circuit tester 46 may have a terminal adapter 48 provided therein which is slipped over the end of the terminal 32. As also seen in FIG. 7, alligator clips 36 may be connected to the ground leads of the electrical test devices for attachment to the terminal 32 or terminal portion 34.

Figure 3:
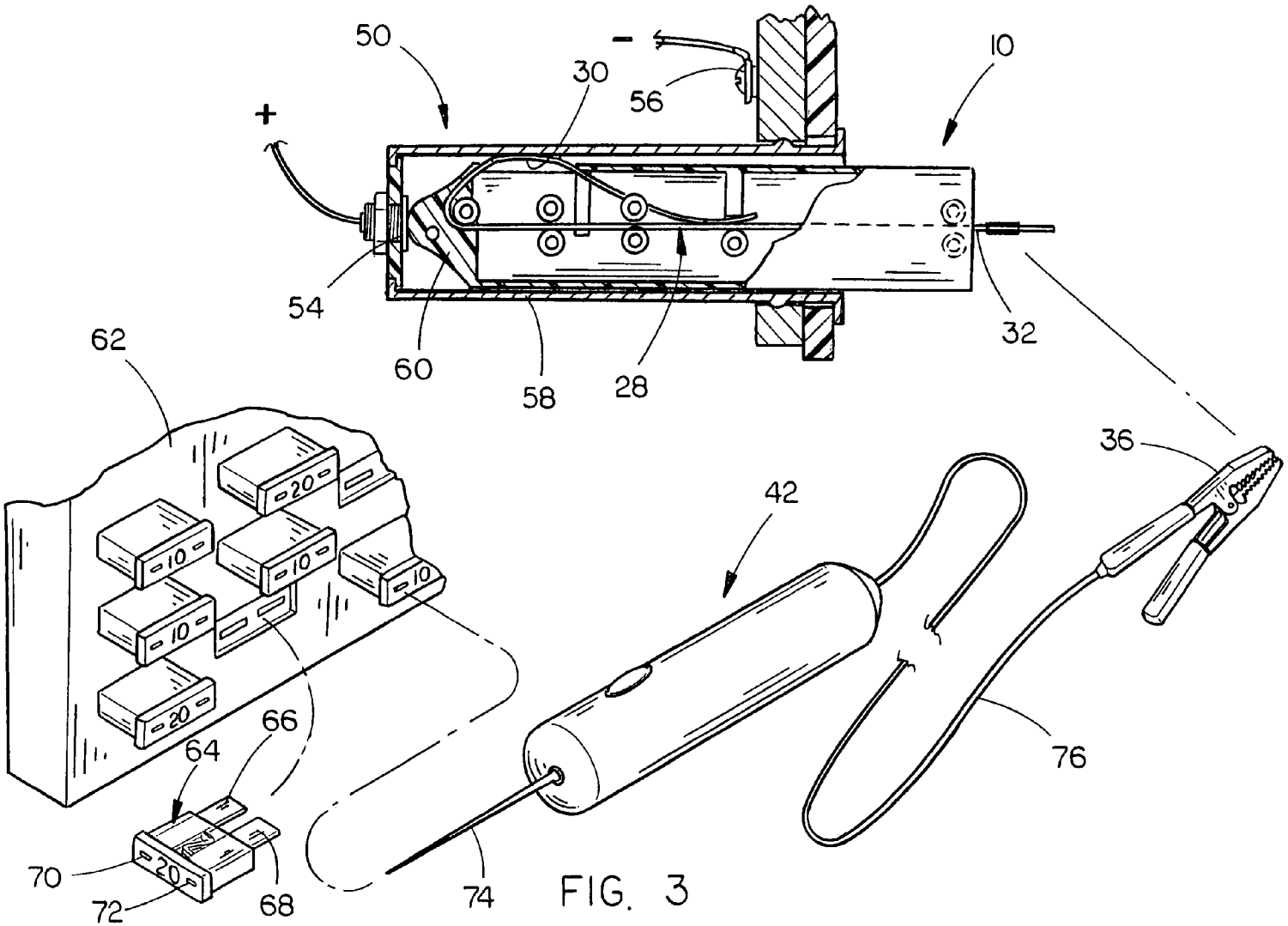
FIG. 3 is a perspective view of a fuse tester which is to be grounded with the grounding plug of this invention being inserted into an accessory outlet port of a vehicle with portions thereof cut away to more fully illustrate the invention.

The grounding plug 10 of this invention is designed to be inserted into a conventional auxiliary power outlet which is referred to generally by the reference numeral 50 in a vehicle 52. As seen in FIG. 3, the auxiliary power outlet 50 includes a "hot" power contact 54 and a ground contact terminal 56 which is electrically connected to the housing 58 of the outlet 50. As seen in FIG. 3, when the grounding plug 10 is inserted into the outlet 50, the contact 30 engages the housing 58 to ground the grounding member 28. The tapered nose 60 engages the hot contact 54 but the electrically insulative characteristics of the plug members 12 and 14 prevent current from flowing into the plug. Thus, the auxiliary power outlet 50 is not actuated, but only serves as a ground for the grounding plug 10.

FIG. 1 illustrates that the vehicle 52 has a fuse panel 62 which contains fuses 64. Each of the fuses 64 includes a pair of terminals 66 and 68 as well as openings 70 and 72 formed in the fuse to enable the probe 74 of the fuse tester 42 to be inserted into one of the openings 70 and 72 to determine if the fuse is faulty. As seen in FIG. 1, the grounding lead 76 of the fuse tester 42 can be easily connected to the terminal 32 or terminal portion 34 by means of the alligator clip 36 so that the fuses 64 may be tested while they are installed in the fuse panel 62. As seen, the grounding plug 10 provides a convenient and readily accessible ground for the electrical test device. The utilization of the plug 10 in the outlet 50 eliminates the need for the technician to attempt to find a metal component on the vehicle to serve as a ground.

Thus it can be seen that the grounding plug of this invention accomplishes at least all of its stated objectives.

I claim:

1. In combination:

an electrical test device having a ground lead extending therefrom;

an elongated grounding plug including a non-electrical conductive body having first and second ends;

an electrically conductive grounding member positioned in said grounding plug body, said grounding member including a first terminal portion protruding from said first end of said grounding plug body and a contact portion extending outwardly from said grounding plug body between said first and second ends thereof;

said first terminal portion of said grounding member adapted to have said ground lead of said electrical device affixed thereto;

said grounding plug adapted to be inserted into an accessory power outlet in a vehicle so that said contact portion of said grounding member will contact the grounding portion of the accessory power outlet thereby grounding said electrical test device.

2. The combination of claim 1 wherein said contact portion yieldably movably extends laterally from said grounding plug body.

3. The combination of claim 1 wherein said ground lead includes an alligator clip which is attached to said first terminal portion of said grounding member.

4. The combination of claim 1 wherein said grounding plug body comprises a pair of plug members which are secured together to form said grounding plug body.

5. The combination of claim 1 wherein said second end of said grounding plug body is tapered.

6. The combination of claim 4 wherein said grounding plug body has a slot formed therein through which the said contact portion extends.

7. The combination of claim 1 wherein a laterally extending second terminal portion is secured to said first terminal portion of said grounding member.

8. The combination of claim 1 wherein said grounding member comprises a flat metal strip bent upon itself to form said contact portion.

9. In combination with an electrical test device having a ground lead extending therefrom, comprising:

an elongated grounding plug including a non-electrical conductive body having first and second ends;

an electrically conductive grounding member positioned in said grounding plug body, said grounding member including a first terminal portion protruding from said first end of said grounding plug body and a contact portion extending outwardly from said grounding plug body between said first and second ends thereof;

said first terminal portion of said grounding member adapted to have said ground lead of said electrical device affixed thereto;

said grounding plug adapted to be inserted into an accessory power outlet in a vehicle so that said contact portion of said grounding member will contact the grounding portion of the accessory power outlet thereby grounding said electrical test device.

10. The combination of claim 9 wherein said contact portion yieldably movably extends laterally from said grounding plug body.

11. The combination of claim 9 wherein said ground lead includes an alligator clip which is attached to said first terminal portion of said grounding member.

12. The combination of claim 9 wherein said grounding plug body comprises a pair of plug members which are secured together to form said grounding plug body.

13. The combination of claim 9 wherein said second end of said grounding plug body is tapered.

14. The combination of claim 12 wherein said grounding plug body has a slot formed therein through which the said contact portion extends.

15. The combination of claim 9 wherein a laterally extending second terminal portion is secured to said first terminal portion of said grounding member.

16. The combination of claim 9 wherein said grounding member comprises a flat metal strip bent upon itself to form said contact portion.

17. A grounding member for an electrical device having a ground lead, comprising:

an elongated grounding plug including a non-electrical conductive body having first and second ends;

an electrically conductive grounding member positioned in said grounding plug body, said grounding member including a first terminal portion protruding from said first end of said grounding plug body and a contact portion extending outwardly from said grounding plug body between said first and second ends thereof;

said first terminal portion of said grounding member adapted to have the ground lead of the electrical device affixed thereto;

said grounding plug adapted to be inserted into an accessory power outlet in a vehicle so that said contact portion of said grounding member will contact the grounding portion of the accessory power outlet thereby grounding said electrical test device.

18. The grounding member of claim 17 wherein said contact portion yieldably movably extends laterally from said grounding plug body.

19. The grounding member of claim 17 wherein said ground lead includes an alligator clip which is attachable to said first terminal portion of said grounding member.

20. The grounding member of claim 17 wherein said grounding plug body comprises a pair of plug members which are secured together to form said grounding plug body.

21. The grounding member of claim 17 wherein said second end of said grounding plug body is tapered.

22. The grounding member of claim 20 wherein said grounding plug body has a slot formed therein through which the said contact portion extends.

23. The grounding member of claim 17 wherein a laterally extending second terminal portion is secured to said first terminal portion of said grounding member.

24. The grounding member of claim 17 wherein said grounding member comprises a flat metal strip bent upon itself to form said contact portion.

25. The combination of claim 9 wherein said electrical test device comprises a fuse tester.

26. The combination of claim 9 wherein said electrical test device comprises a circuit tester.

27. The combination of claim 9 wherein said electrical test device comprises a multimeter.

28. The combination of claim 9 wherein said electrical test device comprises a test light.

* * * * *